US005921871A

United States Patent [19]

Fisher

[11] Patent Number: 5,921,871

[45] **Date of Patent: *Jul. 13, 1999**

[54] GOLF PUTTER HEAD WITH INTERCHANGEABLE REBOUND CONTROL INSERT

[76] Inventor: Dale Perry Fisher, 18055 Bushard St., Fountain Valley, Calif. 92708

[ * ] Notice: This patent is subject to a terminal disclaimer.

[21] Appl. No.: 08/944,080

[22] Filed: Oct. 4, 1997

Related U.S. Application Data

[63] Continuation-in-part of application No. 08/543,813, Oct. 16, 1995, Pat. No. 5,674,132, which is a continuation-in-part of application No. 08/416,135, Apr. 4, 1995, Pat. No. 5,458,332, which is a continuation-in-part of application No. 08/236,583, May 2, 1994, abandoned.

[51] Int. Cl.[6] ..... A63B 53/08

[52] U.S. Cl. ..... 473/329; 473/340; 473/342

[58] Field of Search ..... 473/340, 341, 473/342, 329

[56] References Cited

U.S. PATENT DOCUMENTS

| | | | |
|---|---|---|---|
| 3,695,618 | 10/1972 | Woolley | 473/342 |
| 3,937,474 | 2/1976 | Jepson | 473/342 |
| 4,422,638 | 12/1983 | Tucker | 473/329 |
| 5,332,214 | 7/1994 | Tucker | 473/329 |
| 5,346,213 | 9/1994 | Yamada | 473/342 |
| 5,437,447 | 8/1995 | Rigutto | 473/288 |

*Primary Examiner*—Steven Wong
*Assistant Examiner*—Stephen L. Blau
*Attorney, Agent, or Firm*—William L. Chapin

[57] ABSTRACT

A golf putter providing improved control of distance and direction of a golf ball impacted by the putter includes a resilient insert having a controlled rebound factor fitted into a wedge-shaped recess provided in the face of the putter head. The insert includes a front rebound control pad made of a resilient polymer material, and a rear backing plate releasably fastenable to the putter head. Intrinsic resiliency, thickness and hardness of the pad are chosen to yield in combination with the putter head body an overall, composite ball-impacting rebound factor that may be varied over a relatively wide range of rebound factors, which determine in a substantially linear way the roll distance of a ball impacted by the putter. The insert may be readily interchanged by a golfer with other inserts which provide higher or lower rebound factors, which may be chosen on days in which greens were slower or faster, respectively. Optionally, the hardness of an insert may be varied somewhat independently from rebound factor, thus achieving a desired ball-impacting feel as well as selected rebound factor.

14 Claims, 6 Drawing Sheets

GOLF PUTTER HEAD WITH INTERCHANGEABLE REBOUND CONTROL INSERT

This application is a continuation-in-part of application Ser. No. 08/543,813, filed Oct. 16, 1995, now U.S. Pat. No. 5,674,132, which is a continuation-in-part of application Ser. No. 08/416,135, filed Apr. 4, 1995, now U.S. Pat. No. 5,458,332, which is a continuation-in-part of application Ser. No. 08/236,583, filed May 2, 1994, now abandoned.

BACKGROUND OF THE INVENTION

A. Field of the Invention

The present invention relates to golf clubs. More particularly, the invention relates to an improved golf putter having an interchangeable rebound control insert.

B. Description of Background Art

In theory, golf is a simple game, merely requiring that the player advance a ball from a tee located at the beginning of a fairway into a cup or "hole" located on a green at the end of a fairway, by successively hitting the ball with selected clubs a minimum number of times, or strokes. This progression from tee to green is repeated for the nine or eighteen seriatim fairways or holes which the particular golf course is segmented into. In practice, however, the game of golf can be very frustrating, for a number of reasons.

For long "holes," beginning golfers frequently experience problems with their "long game," i.e., have difficulty in hitting the ball squarely with sufficient force to traverse the fairway from tee to green with a minimum number of strokes. However, for most people that are not physically handicapped, a facility for hitting "long" balls can be developed in a relatively short time, by practicing at driving ranges, for example. On the other hand, beginning golfers often find that, although the skills required to advance the ball from the tee to the vicinity of the green in a reasonable number of strokes can be achieved in a relatively short time, "holing" the ball in the cup can add sufficient strokes to far exceed "par," the idealized, average number of strokes determined to be achievable by expert golfers playing the same hole.

Oftentimes, beginning golfers add excessive strokes to their game because of difficulties experienced in putting the ball into the cup from distant locations on the green. Putting difficulties can arise from the fact that a different set of motor skills are required for putting than for driving the ball from the tee, or hitting long fairway shots. The latter require expenditure of substantial amounts of kinetic energy by the golfer in imparting enough momentum to the ball to propel it for long distances. In putting, raw power or brute force is ineffectual, and the beginning golfer must acquire a substantial amount of finesse in hitting a ball residing on the green, to avoid overshooting the cup and adding unwanted strokes to his game.

Since the amount of momentum that must be imparted to a putted ball is so much less than required to drive a ball appreciable distances, beginning golfers often "pull" their club on short putts, i.e., fail to follow through on their stroke. This pulling or "choking" is detrimental, since the directional control of the impacted ball is adversely affected by such actions. Accordingly, many beginner golfers are confronted with the frustrating situation of putting the ball with good accuracy but beyond the cup, when utilizing their newly acquired skills for long-ball hitting with appropriate follow-through in their stroke. Conversely, choked or pulled strokes can result in the putted ball stopping short of the cup, or deviating substantially away from the cup.

The putting difficulties alluded to above are exacerbated by the substantial variations normally encountered in the conditions of greens. Thus, greens on which the grass is closely trimmed and dry offer minimum rolling resistance to a golf ball, and are "fast." Conversely, greens on which the grass is long and/or wet present substantial rolling resistance to a rolling golf ball, and are "slow." Therefore, the exact amount of momentum that must be delivered to hole a ball varies substantially as a function of green conditions, as well as with distance from the cup.

In recognition of the problems encountered with putting by beginners as well as even relatively experienced golfers, the present inventor disclosed a novel putter design to improve putting skills, in U.S. patent application Ser. No. 08/416,135 filed Apr. 5, 1995, now U.S. Pat. No. 5,458,332, issued Oct. 17, 1995, for a Golf Putter Head With A Cushioning Face. That application discloses heads having on the front face thereof a polymer pad having a rebound factor directly related to the distance to an intended target. For short putts and/or fast greens, a small rebound factor of, say 12.5% was disclosed as being desirable for putts of about 10 feet, 25% for 15–20 foot putts, 37.5% for putts of about 30 feet, and 50% for putts of 40 feet or greater.

By selecting a particular putter from a series of putters fitted with inserts having different rebound factors, the disclosed invention enabled golfers to utilize strokes that varied over a smaller power range, even for widely varying putting distances and green conditions. For example, by using a putter having an insert with a low rebound factor of 12.5%, the ball may be struck with nearly the same vigor for a 10 foot putt as for a 40 foot putt using a putter having a higher rebound factor of 50%. Therefore, the player can use a complete stroke with the follow through required for accurately launching the ball towards the cup, even for short putts and/or fast greens, by using a putter having an insert with an appropriately low rebound factor.

In addition to the substantial contribution to improved putting afforded by putters having inserts with rebound factors optimized to various putting situations, the present inventor's prior application disclosed putters in which the rebound factor of an insert could be varied somewhat independently of hardness. This capability permits the feel of the club upon impacting the ball to be adjusted somewhat, thus allowing inserts with varying rebound factors to provide similar sensory feedback upon impacting a golf ball.

The golf putter heads described in the present inventor's U.S. Pat. No. 5,458,332 referred to above provided a substantial contribution to improving a golfer's putting performance. However, a problem still existed for golfers approaching the green.

In the "short" portion of a golf game, it is usually necessary to hit the ball onto the green from a fairway, rough or sand trap. Such locations are oftentimes well within a golfer's maximum distance hitting capability. Accordingly, clubs with an inclined front face that provide a substantial vertical component (loft) to the ball trajectory are often used in approaching the green. A high trajectory minimizes the likelihood of overshooting the green, and results in the ball impacting the green at a relatively steep angle, thereby minimizing roll away from the impact point. In spite of making a careful choice of the best club to prevent exceeding a desired horizontal range, many players are confronted in their short games with the same dilemma as in putting; namely, maintaining normal swing and follow through to achieve good trajectory direction, and possibly overshooting an intended impact point, or pulling the shot to decrease horizontal range, while adversely affecting angular or bearing accuracy, and/or falling short of a desired impact point.

In view of the problems alluded to above, it occurred to the present inventor that some of the novel improvements which he disclosed in his U.S. Pat. No. 5,458,332, for putters might be adapted to other varieties of golf clubs, including wedges and other irons, as well as woods. Such considerations were in part a motivation for further inventions by the present inventor, which were disclosed in U.S. patent application Ser. No. 08/543,813, filed Oct. 16, 1995, now U.S. Pat. No. 5,674,132 to be issued Oct. 7, 1997 for a golf club head with a rebound control insert.

In the course of applying the improvements in putter construction disclosed in the '332 patent to other types of golf clubs, it was found that the larger ball impact forces typically encountered in using the latter suggested a somewhat more rugged design, to ensure that the polymeric insert on the club face could be attached securely to a club head, and by a relatively simple manufacturing technique. As it turned out, the newly conceived design for improved woods and irons turned out to be advantageously useable with the putter head design previously disclosed by the present inventor.

The present invention was conceived of to provide a golf putter including a head provided with an insert which may be readily interchanged to provide different rebound factors and/or hardness. Different rebound factors may be selected to suit a player's particular putting style. For example, a consistently heavy hitter might choose a lower rebound factor, to avoid overstroking a hole. On the other hand, the same player might choose a higher rebound factor for use on a particular day at a particular course when the greens were slower, because the grass was wet and/or longer. Different hardness values may be selected to provide a different feel upon impacting a ball.

OBJECTS OF THE INVENTION

An object of the present invention is to provide a golf putter including a head having at the front face thereof a resilient rebound control pad secured to the head by releasable fastening means that permit interchanging the pad with a pad which provides a different rebound factor and/or hardness.

Another object of the invention is to provide a golf putter head including a body having a front face in which is formed a recess which releasably holds a selected one of a plurality of interchangeable rebound control inserts which provide in combination with the body different predetermined rebound factors and/or relative hardnesses.

Another object of the invention is to provide a golf putter head including a body having in the front face thereof an interchangeable rebound control insert having a vertical span at least as great as the front face of the body.

Another object of the invention is to provide a protective mitt or cover for golf clubs, the mitt having a transparent window positioned over a color-coded insert on a putter.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described in this specification are merely illustrative of the preferred embodiment. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends improved golf putters having at the front ball-impacting face of the putter, head body a rebound control pad which is releasably attached to the body. The pad may be selected from a plurality of pads which provide different rebound factors and/or hardnesses, to suit different strokes of different golfers, different green speeds, or different desired feel characteristics.

In a preferred embodiment of the invention, interchangeable rebound control inserts are provided which each consist of a front rebound control pad made of a resilient material, the pad being attached to a rear fastener plate. A recess formed in the front face of the putter head body receives the insert, which is secured to the body by screws which are inserted through holes which extend through the body and the bottom wall of the recess, the screws threadably engaging blind threaded holes in the rear surface of the insert. In the preferred embodiment, the front pad of the rebound control insert is made of a resilient polymer, and has a relatively flat front face which is parallel to, and approximately flush with, portions of the club head body face adjacent to the recess.

According to one aspect of the invention, a rebound control insert pad is chosen from a first plurality of resilient polymers which yield, in combination with the fastener plate and characteristics of the club head body, a desired composite rebound factor for a ball impacted by the front face of the pad when the ball is struck by the club, the roll distance of the ball being directly related to the composite rebound factor. Higher composite rebound factors would generally be chosen on days in which the greens of a particular course were slow and conversely, lower rebound factors would be chosen for fast green conditions.

According to another aspect of the invention, the hardness of a rebound control insert is varied by varying the composition of the polymer material from which the insert pad is made while varying the thickness of the pad, if necessary, to achieve a desired composite rebound factor.

In a modification of a basic rebound control insert construction according to the present invention, the resilient pad of the insert is fabricated as a multi-layered structure comprising two or more insert laminations. The composition, resiliency or intrinsic rebound factor, hardness and thickness of each of the insert laminations as well as the thickness of the backing plate, may be varied, resulting in a substantially larger range of available composite rebound factors and surface hardnesses.

In the preferred embodiment of the present invention, the recess in the front face of putter head body and the inserts each have trapezoidal or wedge-shaped plan views, with side walls that slope inwardly towards a vertical center line, from the bottom of the top of the face. Preferably, the recess and insert both penetrate the upper surface of the club head. With this construction, the upper surface of the insert provides a visual indicator that helps a golfer to impact a ball with the center of percussion, or "sweet spot" of the club head aligned with the impact velocity vector. Moreover, a construction in which the front ball impacting surface of the insert pad spans the entire height of the club face insures that a golf ball will be impacted only by the pad regardless of how low or high a golf ball is impacted by the putter head.

Preferably, each insert has a distinctive color which denotes a particular rebound factor and/or hardness. According to another aspect of the invention, a novel protective mitt is provided which may be used to cover the head of a club fitted with a color-coded insert, when the club is not in use. The protective mitt has a transparent insert or window that overlies the club head insert. With this arrangement, a golfer may readily determine which rebound control insert is currently installed on a putter, by viewing the insert through the mitt window.

DESCRIPTION OF THE PREFERRED EMBODIMENTS

FIGS. 1–7 illustrate golf putters with interchangeable rebound control inserts according to the present invention.

Figure 1:
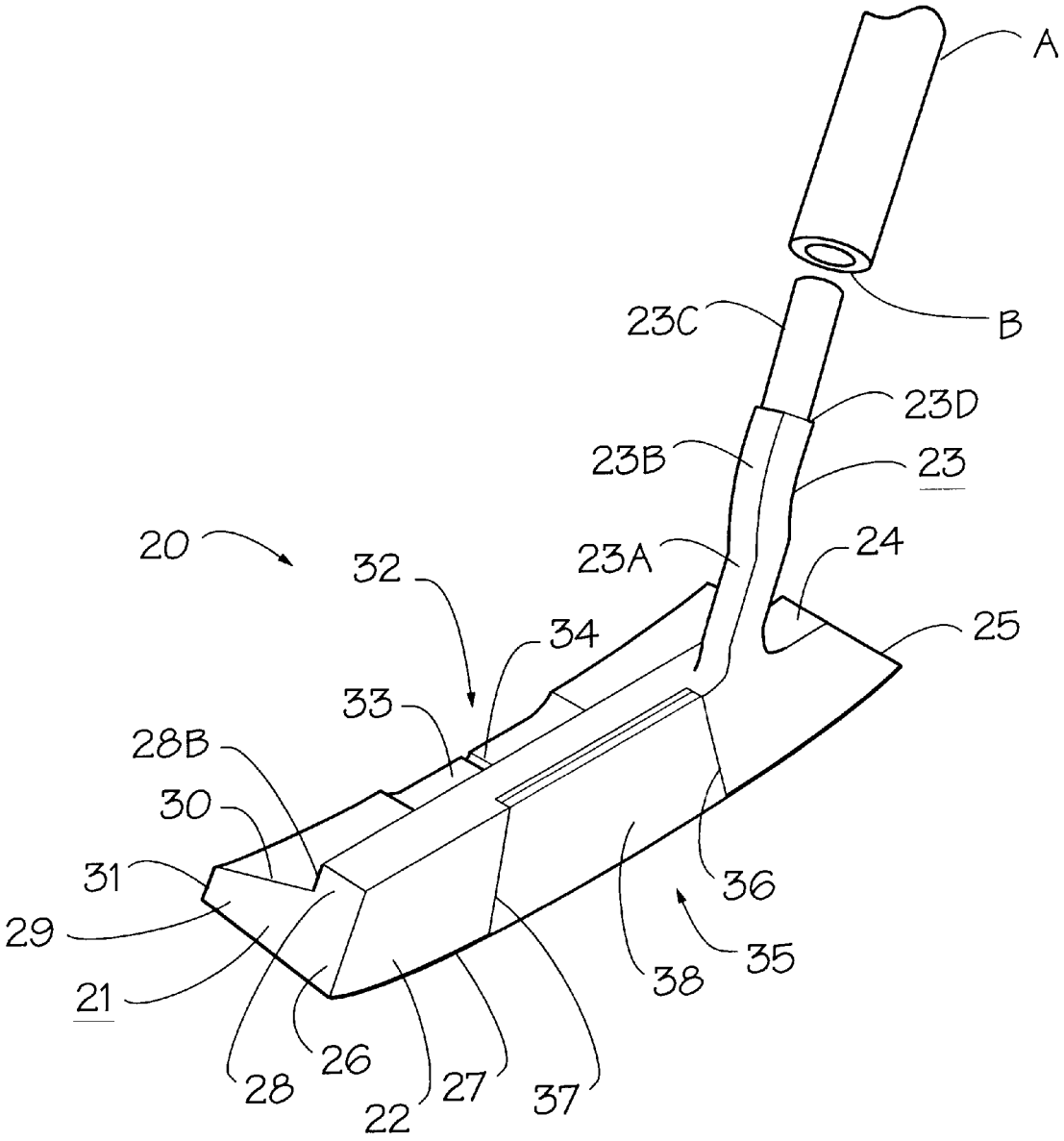
FIG. 1 is an upper perspective view of a golf club putter head with an interchangeable rebound control insert according to the present invention.

Referring now to FIG. 1, a golf club putter head 20 according to the present invention is shown. Putter head 20 may be attached to shaft A, shown fragmentarily in FIG. 1, by conventional means to comprise a complete golf putter.

As shown in FIG. 1, golf club putter head 20 according to the present invention includes a horizontally elongated body 21 having a generally flat, generally vertically disposed front face 22 adapted to impacting a golf ball. Putter head body 21 has an elongated, generally cylindrically-shaped shank 23 or hosel that protrudes upwards from the upper wall 24 of the body. As shown in FIG. 1, shank 23 joins upper wall 24 of body 21 at a location offset laterally outwards from the center of front head face 22, near the angled right-hand side wall 25 of the body. As is also shown in FIG. 1, in front elevation view, shank 23 has a lower portion 23A that protrudes generally vertically upwards from upper wall 24 of body 21, and intermediate and upper portions 23B and 23C, respectively, that angle laterally away from a vertical center line through the body.

Figure 3:
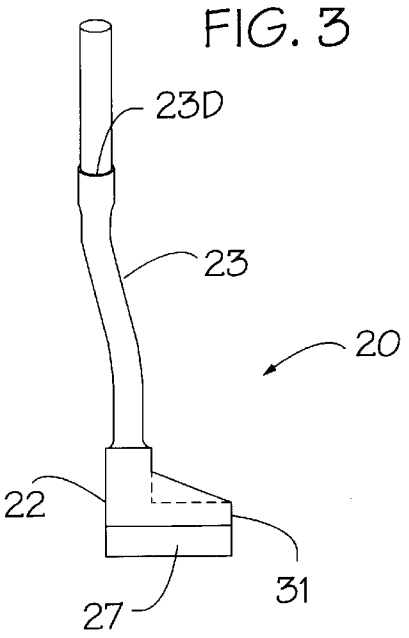
FIG. 3 is a right side elevation view of the putter head of FIG. 1.

As may be seen best by referring to FIG. 3, in side elevation view, lower portion 23A of shank 23 angles sinuously forward of front face 22 of putter head body 21, while intermediate portion 23B of the shank bends rearward to join upper portion 23C, the latter two portions lying in a laterally disposed vertical plane.

As shown in FIGS. 1 and 3, upper portion 23C of shank 23 has a circular cross section which is adapted to be invertably received within the bore of tubular putter shaft A. Preferably, upper cylindrical portions 23C of shank 23 is of smaller diameter than the adjacent part of intermediate portion 23B of the shank, and is joined thereto by an annular shoulder 23D. Shoulder 23D provides a seating surface for the lower annular wall surface B of putter shaft A.

Figure 4:
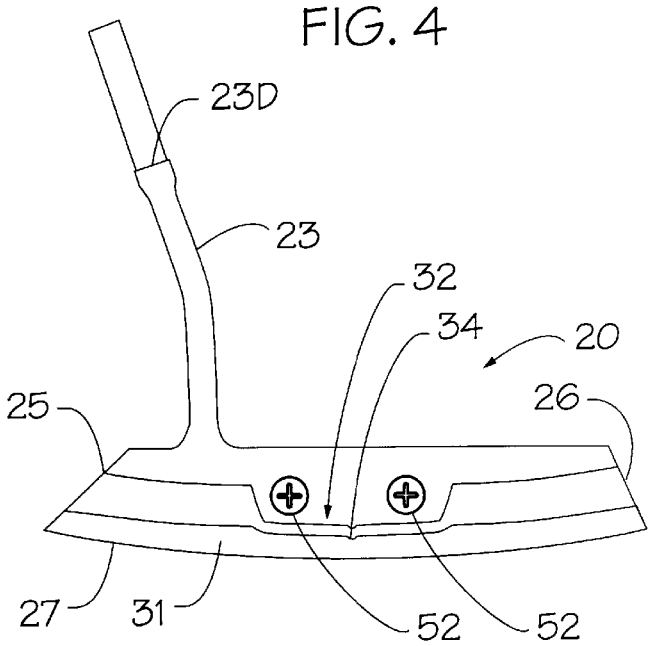
FIG. 4 is a rear elevation view of the putter head of FIG. 1.
Figure 5:
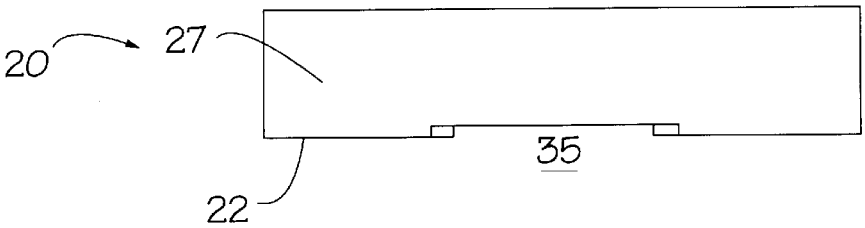
FIG. 5 is a bottom plan view of the putter head of FIG. 1.

As may be seen best by referring to FIG. 1, body 21 of putter head 20 has a flattened, convexly curved lower wall surface 27. As shown in FIGS. 1, 3 and 4, putter head body 21 has an upper laterally disposed rectangular transverse cross section rib portion 28 that protrudes downwards from upper wall surface 24 of the body. Also, the rear portion of body 21 includes a trapezoidal transverse cross section portion 29 having an angled wall surface 30 that intersects rear wall 28B of rib portion 28 below upper surface 24, the angled wall sloping downwards and rearwards to intersect back vertical wall surface 31 of the body. As may be seen best by referring to FIGS. 1 and 4, a lateral, medial portion of trapezoidal portion 29 of putter head body 21 is cut downwards from angled wall 30 to form a notch 32. The lower wall surface 33 of notch 32, which forms with lower wall surface 27 of body 21 a think web, preferably has marked thereon a longitudinally disposed indicator or index line 34. Index line 34 is parallel to and midway between right and left side walls 25 and 26 of body 21. Thus, index line 34 signifies to a golfer the ideal spatial orientation of the putter head velocity vector with respect to a golf ball impacted by the head.

Figure 2:
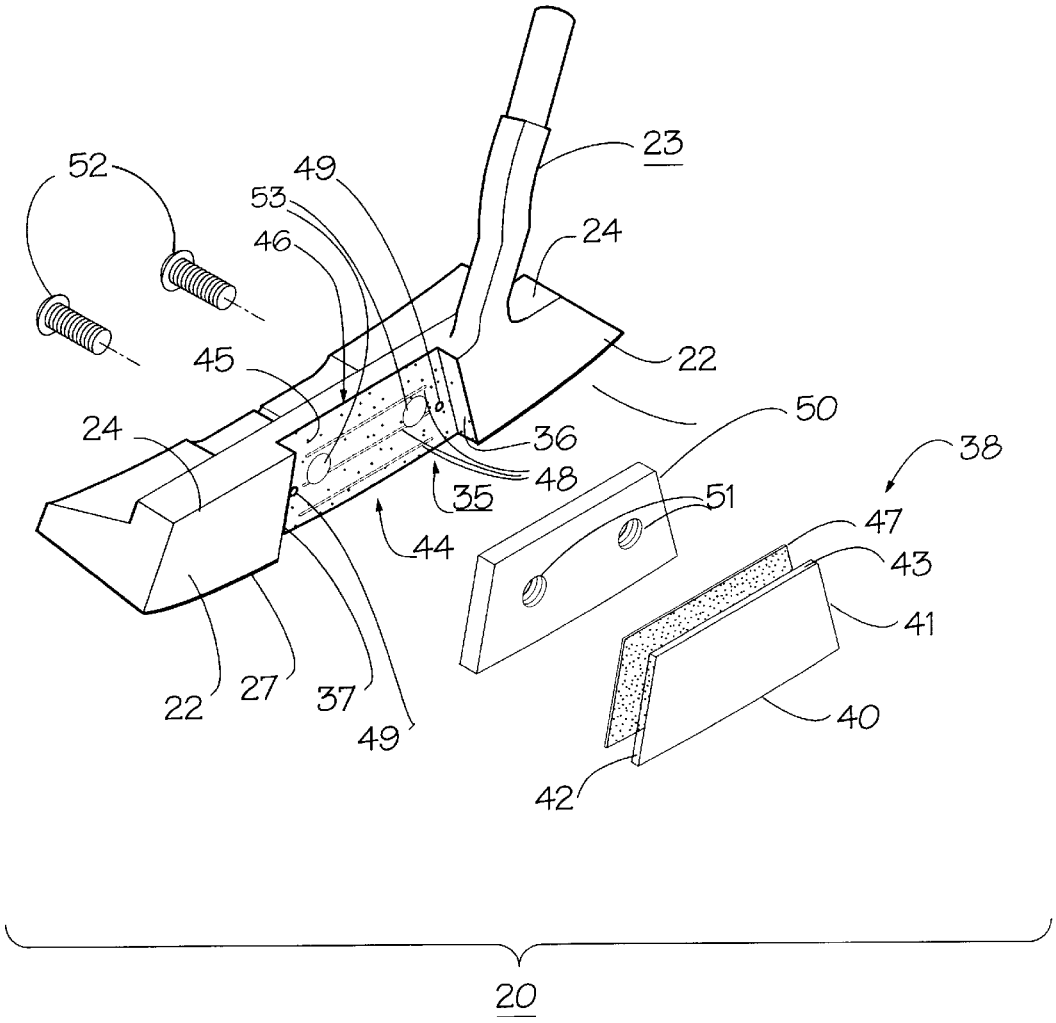
FIG. 2 is an exploded front perspective view of the putter head of FIG. 1.

Referring now primarily to FIGS. 1 and 2, but also to FIGS. 3–6, the novel construction and function of putter head 20, employing interchangeable rebound control inserts, will now be described in detail.

As shown in FIGS. 1 and 2, front face 22 of putter head body 21 has formed therein a recess 35 which extends perpendicularly inwards or rearwards into the body. Recess 35 has a uniform transverse cross section, shaped like a wedge or trapezoid. Thus, recess 35 has angled straight right and left side walls 36 and 37 which penetrate lower wall surface 27 of club head body 21, forming a thin, laterally elongated rectangularly-shaped opening 44 in the lower wall surface. Side walls 36 and 37 of recess 35 angle inwards towards a vertical center line of the recess, and extend upwards towards upper wall surface 24 of body 21. Side walls 36 and 37 penetrate upper wall surface 24, thus forming a thin, laterally elongated rectangularly-shaped opening 46. Thus, as shown in FIGS. 1 and 2, right and left side walls 36 and 37 of recess 35, in combination with those portions of upper wall 24 and convexly curved lower wall 27 that are pierced by the recess, form a generally trapezoidal shape, modified by a convexly curved base. As may be seen best by referring to FIG. 1, side walls 36 and 37 of trapezoidally-shaped recess 35 are spaced equidistant from a vertical longitudinally disposed center plane passing through index line 34 in rear notch 32 of body 21. Recess 35 is adapted to receive and hold interchangeable rebound control inserts 38, as will now be described.

Referring now to FIG. 2, putter head 20 may be seen to include an interchangeable rebound control insert 38 that fits within recess 35 in front face 22 of body 21 of the head, and is releasably attachable to the body. As shown in FIG. 2, insert 38 includes a front pad 39 fabricated from a thin sheet of polymeric having a uniform thickness and controlled rebound characteristics.

Insert 38 has a plan view shape complementary to that of recess 35. Thus, insert 38 has a horizontally disposed, slightly convexly curved lower base wall 40, and straight right and left side walls 41 and 42 which angle inwards and extend upwards to a straight, horizontally disposed upper edge wall 43.

As shown in FIG. 2, insert 38 includes a rear backing plate 50. Backing plate 50 is preferably of uniform thickness, and comprises a thin metal plate, made of brass, for example. As may be seen best by referring to FIG. 6, backing plate 50 has formed therethrough a pair of laterally spaced apart, threaded screw holes 51.

In a preferred embodiment of interchangeable insert 38, front resilient pad 39 is secured to rear backing plate 50 by an adhesive layer 47 between inner flat wall surface 44 of the pad and front wall surface 45 of the backing plate. In example embodiments of insert 30, adhesive layer 47 consisted of a double-sided adhesive tape strip, coated on both sides with a pressure sensitive adhesive. In this embodiment, adhesive layer strip 47 is sandwiched between front insert pad 39 and rear backing plate 50, and the sandwich squeezed to adhere the pad and backing plate together.

As may be seen best by referring to FIGS. 1, 2, and 4, insert 38 is releasably secured to putter head body 21 by a pair of headed screws 52 inserted through a pair of longitudinally disposed, laterally spaced apart holes 53 which extend through rib section 26 of putter head body 21. Screws 52 are threadingly secured by and tightened into threaded backing plate holes 51, thereby readily securing a selected insert 38 in recess 35 of putter head 20. Conversely, an interchangeable insert 38 having a particular rebound/hardness characteristics may be replaced by an insert having different desired characteristics by simply loosening screws 52, removing the first insert, and replacing it with a different insert.

In example embodiments of insert 38, resilient pad 39 and backing plate 50, each had a thickness of about three thirty-seconds (3/32) inch. Insert pad 39 is preferably constructed of a material that has a hardness less than that of the remainder of club head body 21, which is typically made of cast metal or hard, dense wood to provide a desired weight. Also, insert pad 39 is preferably made of a synthetic polymer material that has a characteristic or intrinsic rebound factor, coefficient of restitution, or resiliency that is selected to provide particular momentum-imparting characteristics to a ball impacted by the insert. Rebound factor (RF) is here defined in the usual way as being the ratio of the height (h) reached by a ball bouncing off an insert to the height (H) the ball was dropped from onto the insert. The coefficient of restitution (CR) of the insert is defined as being equal to the ratio of rebound velocity to impacting velocity, and is equal to the square root of the rebound factor, i.e., $CR=V_{rebound}/V_{impact}=\sqrt{RF}=\sqrt{h/H}$.

According to the invention, insert pad 39 also preferably has a hardness that is selected according to a golfer's preference for a particular "feel" upon impacting a ball. In further accordance with the invention, inserts of a particular rebound factor are provided with different hardness values, to suit a golfer's particular desires. In an example embodiment of putter head 20 according to the present invention, insert pads 39 were made of solid polyurethane having a hardness in the range of Shore A 70 durometer to Shore D 80 durometer.

To adjust for different putting distances, different insert pads 39, having different rebound factors were used, the rebound factors preferably varying in the range of 12.5% to 50%, or more, of the rebound factor for an ideal "live" standard, i.e., a perfectly elastic impact in which substantially all of the energy absorbed by the insert in being deformed upon impacting a golf ball, is returned to the ball. As was pointed out in the present inventor's previous disclosure, the present inventor has determined that for a particular insert durometer reading, a rebound factor of about 25 percent is desirable for a medium putt. Furthermore, a rebound factor of about 50% has been determined to be desirable for long putts, while a 12.5% rebound factor is desirable for short putts.

The actual rebound factor of a golf ball impacted by insert 38 of course depends on the coefficient of restitution of the ball, as well as that of the insert. Also, for a given golf ball coefficient of restitution, the overall rebound factor of a ball impacted by insert 38 is a composite function (composite rebound factor, CRF), depending not only upon the rebound factor of the polymer material of which the insert is made, but also upon the thickness of the insert, and upon the properties of the club head body or other object supporting the insert. Thus, for a very thin insert, the overall rebound factor depends to a larger extent on the rebound factor of the club head body 21. Conversely, for a very thick insert, the ball rebound will depend to a larger extent on the rebound factor, or coefficient of restitution characteristic of the insert material.

Because of the relationship between the composite, overall ball rebound factor and the thickness of insert 38, the thickness of a given Shore hardness insert material may be varied to vary the ball rebound factor. Thus, for example, the thickness of insert 38 can be varied to values above and below a nominal value of 3/32 inch, to values of 1/16th inch, or less to 3/16th inch, or more, for example. It is important to note that the rebound factor characteristics of the material of the insert pad 39, as well as the thickness of the material and of backing plate 50, may be varied over a relatively wide range, to achieve overall ball rebound factors that vary over a substantial range, while using a Shore hardness desired by a particular golfer. This rebound factor range can extend to values smaller than those of a metal, wood or composite club head without an insert 38, to substantially larger values. Table 1 lists typical rebound factors and corresponding coefficients of restitution that may be selected from.

TABLE 1

INSERT REBOUND FACTORS AND COEFFICIENTS OF RESTITUTION

| RF | CR |
|---|---|
| 50% | .707 |
| 37.5% | .612 |
| 25% | .500 |
| 12.5% | .354 |

Figure 6:
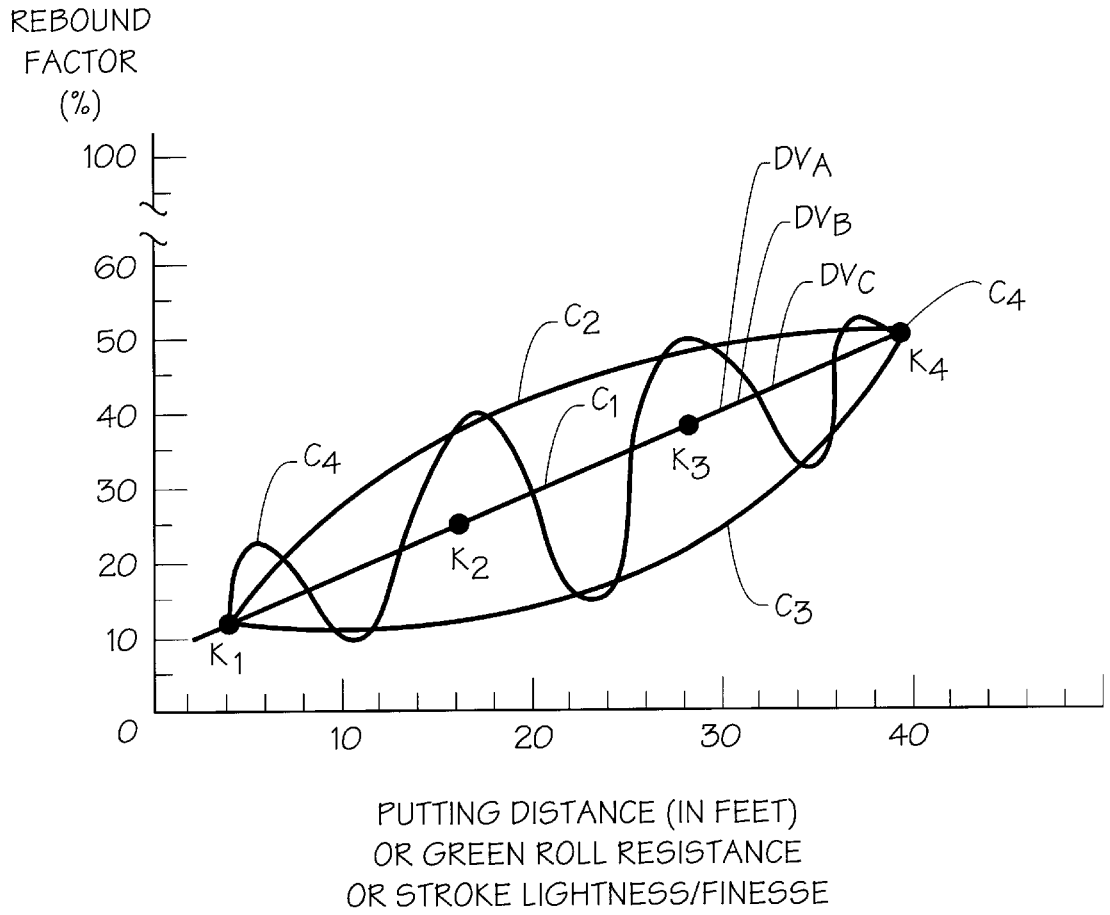
FIG. 6 is a graph indicating how a particular composite rebound factor for the putter head of FIG. 1 may be selected, based upon any combination of the factors, putting distance, green speed, and customer's putting stroke.

The particular rebound factor of an insert is preferably chosen as a function of the putting distance to a hole, as is illustrated in FIG. 6 and discussed below.

When a golf ball is impacted by insert 38 of putter head 21, the ball compresses the insert a pre-determined amount at the region of impact, the amount of compression depending upon the selected rebound factor. For inserts made of relatively lower resiliency materials, a larger proportion of the impact energy is absorbed by deformation of the insert, so that a golf ball is driven a shorter distance, with consequent greater control of ball direction and roll, than would otherwise be the case with prior art putters. This greater control enables a golfer to execute a smooth, continuous full swing in impacting the ball, without fear of over-driving the ball.

Depending upon the distance to the cup and the degree of control and feel required to sink a putt, the golfer can preselect a suitable putter from a set of putters, each provided with an insert 38 having a different rebound factor. A set of rebound factors for inserts 38 found suitable for most applications by the present inventor includes values of 12.5%, 25%, 37.5% and 50% or greater. Preferably, inserts 38 with different rebound factors are color coded, to facilitate quick selection of a putter provided with an insert having a desired rebound factor.

A graph plotting suitable rebound factors for inserts 38, as a function of approximate putting distance, is given in FIG. 6. As shown in FIG. 6, the present inventor has found that an insert 38 having rebound factor K1 of about 12.5% is suitable for short putts, of the order of 4 feet or less. Similarly, a rebound factor K2 of about 22.5% for putts of about 16 feet, K3 of about 37% for putts of about 28 feet, and K4 of about 52% for putts of about 40 feet were found suitable.

As indicated in FIG. 6, what appears to be a single (straight line) curve C1 plotting desired rebound factors of inserts 38 as a function of putting distance, is in actuality a coalescence of three separate identical straight line plots, for inserts having three different hardnesses in the durometer range of 70A to 80D. Thus, using a polymeric material of the type specified above, in which rebound factors may be varied over a desired range, while fixing hardness as a parameter, enables a golfer to not only choose an insert 38 having a rebound factor RF most suitable for a particular putting distance, but also to choose independently the insert hardness that provides the golfer with the desired feel.

As shown in curve C1 of FIG. 6, the preferred functional relationship between rebound factor and putting distance is linear. However, it is to be understood that the precise values of rebound factor K may vary somewhat because of ordinary variations in manufacturing tolerances. Also, it may be desired to increase or decrease the rebound factors for intermediate putting distance from the values shown for the linear curve C1 in FIG. 6. Thus, the functional relationship between rebound factor and putting distance may deviate from the linear curve C1 shown in FIG. 6, either upward to convex curve C2 or downwards, to concave curve C3, or alternating upwards and downwards, as illustrated by curve C4. Such variations are within the scope of the invention, and achieve the desired beneficial results, as long as rebound factor RF is a single-valued, increasing function of putting distance.

As described above, inserts 38 were fabricated from a resilient polyurethane material. Other resilient polymers may also be used for insert 38, provided that the polymer affords the desired combination of a selectable Shore hardness and rebound factor. For polyurethane having a hardness in the range of Shore A70 durometer to shore D80 durometer stated in the examples above, the material may be referred to as an elastomer. However characterized, I have found that the resilience of insert 38 affords a distinct advantage over club head constructions employing solid, non-resilient inserts. A problem exists with solid inserts, because differing coefficients of thermal expansion for the insert and club head materials can cause loosening of the insert, or permanent warpage of the insert and/or the head, if left inside a hot automobile, for example.

Figure 7:
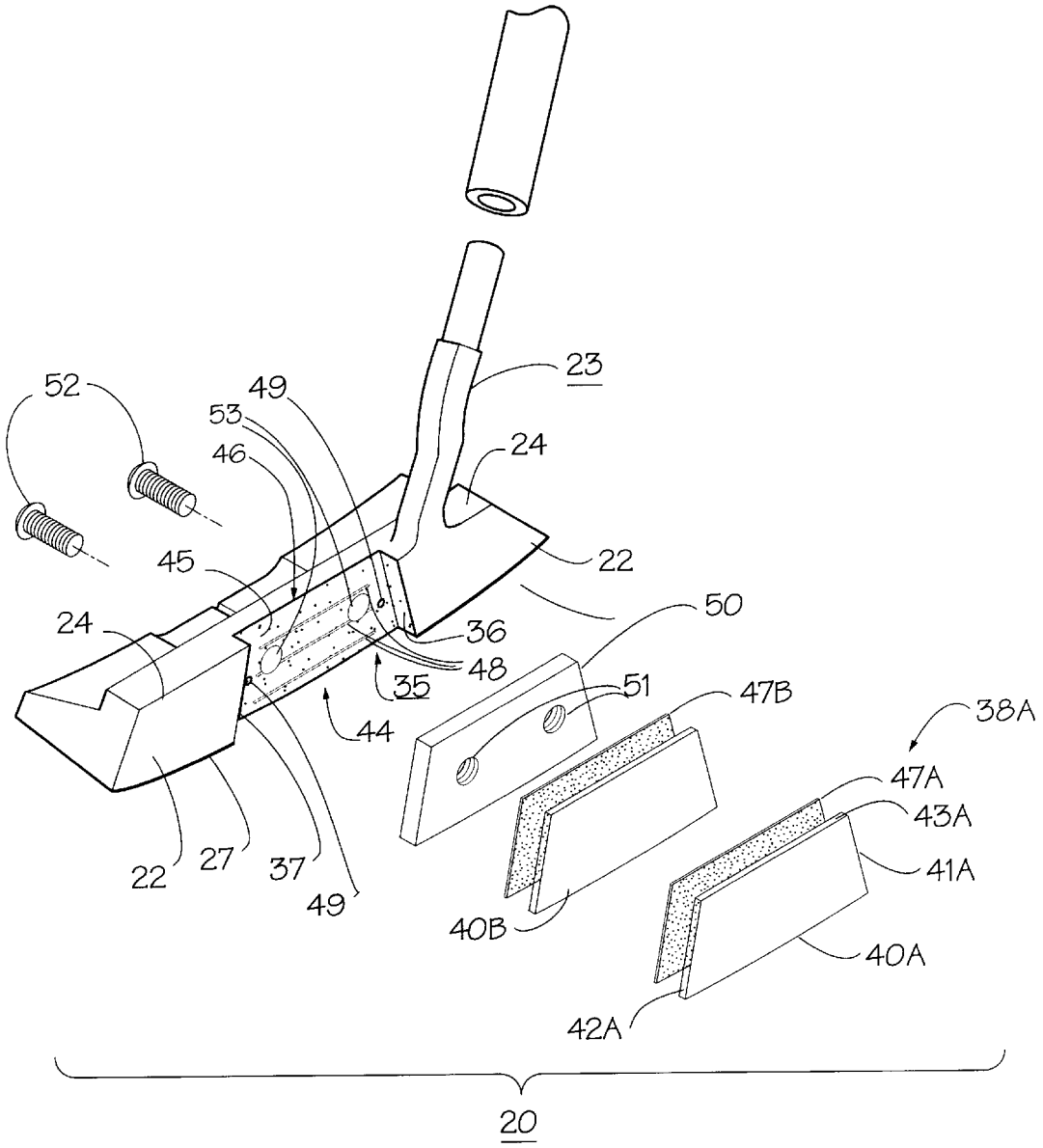
FIG. 7 is a fragmentary exploded front perspective of a modification of the golf putter head of FIG. 1, showing a modified, multi-lamination insert therefor.

FIG. 7 illustrates a modification of the putter head according to the present invention. The modified putter head 20A in FIG. 7 utilizes an insert 38A having a plurality of stacked insert pads or laminations, such as insert pads 39A and 39B, rather than a single insert pad. This multi-layered, laminated insert structured, as shown in FIG. 7, utilizes inserts made of resilient materials having different durometer hardnesses and/or different rebound factors. Stacking two or more insert laminations such as 39A and 39B which have different rebound factors and/or hardnesses allows the overall rebound factor, and/or the perceptible hardness, of the stacked lamination to be varied over a substantially larger range than could be achieved with a unitary, one-piece insert. The range of variability can be further increased by varying the thickness of one or more of the laminations used to make the insert, as is described in further detail below.

In tests performed by the present inventor on inserts attached to club head body 21, outer insert pad 39A and inner insert pad 39B were made from materials having different durometer values and/or rebound factors, and thicknesses of 1/16 inch, 1/8, and 1/4 inch. In a first example, a 1/8 inch thick inner or bottom insert pad 39B having a high rebound factor was overlain with a 1/16 inch thick upper or outer insert pad 39A having a lower rebound factor. The laminations 39A and 39B were adhered to one another and to lower surface 45 of recess 35 in club head body 21 with 3M double stick tape. With a high rebound factor insert pad 39B on the bottom and a low rebound factor insert 39A on top, the overall rebound factor of the dual lamination insert increased approximately 30% over the rebound factor of a single 3/16 inch thick insert having the same low rebound factor as outer lamination 39A.

In example 2, a laminated insert 38A was made with laminations 39A and 39B reversed, i.e., with a low rebound factor, inner insert pad 39B, and a high rebound factor outer insert pad 39A. In this case, the overall rebound factor of the dual lamination was less than that of a single 3/16 inch insert having the same high rebound factor as outer insert lamination 39A.

In a third example embodiment of a dual lamination, multi-layer insert, inner or bottom insert lamination 39B was made from a 1/8 inch thick polyurethane sheet having an 85A durometer and a high rebound factor. The outer or top insert lamination 39A was made from a 1/8-inch thick polyurethane sheet having an 85A durometer and a low rebound factor. With this arrangement, the overall rebound factor was altered to a value intermediate the intrinsic rebound factors of the two insert lamination materials, i.e., to a value somewhat larger than the low rebound factor of outer lamination 39A.

In example 4, the relative positions of the low and high rebound factor insert laminations 39A and 39B were reversed, thus positioning the high rebound factor material in the outer insert location. With this arrangement, the overall rebound factor was decreased from the high rebound factor of outer lamination 39A.

In example 5, the low rebound factor inner insert lamination 39B of example 4 was replaced with a polyurethane material having a similar low rebound factor, but of somewhat greater hardness. In this case, the overall rebound factor decreased approximately 25% from the intrinsic rebound factor of the outer insert 38A. In addition, the perceptible hardness of the two-lamination insert upon impacting a golf ball increased over that experienced using the outer insert material alone.

In a sixth example, a series of tests were performed in which the relative thicknesses of inner insert lamination 39B and outer insert lamination were varied to determine the effects of thickness ratios on alterations of overall rebound factor and/or perceptible hardness of outer insert lamination 39A by inner insert lamination 39B. In these tests, it was determined that if outer lamination 39A had a greater thickness than inner lamination 39B, for example, ¼ inch versus 1/16 inch, the durometer and rebound factor characteristic of the inner lamination material had relatively smaller effects on the overall rebound factor and perceptible hardness of the multi-layer insert. Conversely, when the thickness inequality was reversed, with a thinner outer insert lamination 39A compared to inner lamination 39B, 1/16-inch versus ¼-inch, for example, the overall rebound factor and perceptible hardness were more strongly affected by the durometer and rebound factor of inner insert pad 39B.

In general, it was observed that the overall rebound factor was more strongly affected by the rebound factor of inner insert lamination 39B, than perceptible hardness by the hardness of inner insert lamination 39B. Thus, in example 7, a dual-lamination insert was made using a ⅛-inch thick outer insert of 90A durometer, and an inner insert lamination of ⅛ inch thickness and 70A durometer. In this example, the perceptible hardness of the combination decreased only slightly. With the thickness of the outer 90A durometer insert pad 39A reduced to 1/16 inch, the effect was greater, reducing the perceptible hardness by about 15%.

EXAMPLES

In an example embodiment of the present invention, golf putter 20 according to the present invention was constructed using interchangeable inserts 38 having different rebound and/or hardness properties.

In a first example embodiment, inserts were fabricated from polymer sheets having a thickness of about ⅛th inch and made from different polyurethane materials obtained from Bailey-Parks Company. The Bayshore resilience of each of these inserts was tested, as was the composite rebound factor for a golf ball dropped on the horizontally disposed face of a golf putter 20, with the golf club resting in a level, horizontal position on a wooden table. Subsequent composite rebound tests were performed on a putter 20 in which the shaft and grip were held in a horizontal position by a clamp fastened to hosel 23 near its attachment point to the shaft, and yielded substantially the same composite rebound factors. Ball roll distance tests were also performed by clamping the grip of a putter to be tested onto the arm of a robot putter, which arm was part of a composite pendulum pivotable in a vertical plane from a precisely predetermined, locked position, and released to deliver a precisely pre-determined and repeatable impact moment to a golf ball placed on a carpet. The results of tests performed on these example embodiments of putter 20 according to the present invention are summarized in Table 2.

TABLE 2

INTERCHANGEABLE INSERT TESTS

| MATERIAL | SHORE HARDNESS | BAYSHORE RESILIENCY | COMPOSITE REBOUND FACTOR CRF | ROLL DISTANCE, FEET |
|---|---|---|---|---|
| BP 9085-85A | 85A | 29% | 34% | 14 |
| BP 602-85A | 85A | 48% | 37% | 15 |
| BP 625-85A | 85A | 51% | 40% | 17 |
| / / / | | | | |

As shown in Table 2, different inserts 38 may be made having the same hardness value (85A), but having substantially different composite rebound factors. Furthermore, the roll distance of a golf ball impacted by a putter 20 fitted with an interchangeable insert 38 was found to be directly and substantially linearly related to the composite rebound factor. Also, roll distance tests were repeated many times, confirming that the roll distance was precisely repeatable, and thus illustrating the advantageousness of the present invention in achieving, for each selected rebound factor, a controlled, precisely determinable roll distance.

As is also shown in Table 2, the composite rebound factor of a golf putter 20 fitted with an interchangeable insert 38 varies in the same general direction as the Bayshore resilience of the insert material, but not in a readily calculable way.

In additional tests, putter 20 according to the present invention was fitted with inserts made of materials different from the polyurethane used for the inserts of Table 2. For these examples, Adiprene having a Shore hardness of 92A yielded a composite rebound factor of 42.5%, a hard black balata rubber having a hardness of 90A had a composite rebound factor of 22 percent and a red rubber insert having a Shore hardness of 70A had a CRF of 18 percent. These tests confirmed that the hardness of an insert material proved to have even a less ascertainable, much less calculable relationship between hardness and composite rebound factor.

Figure 8:
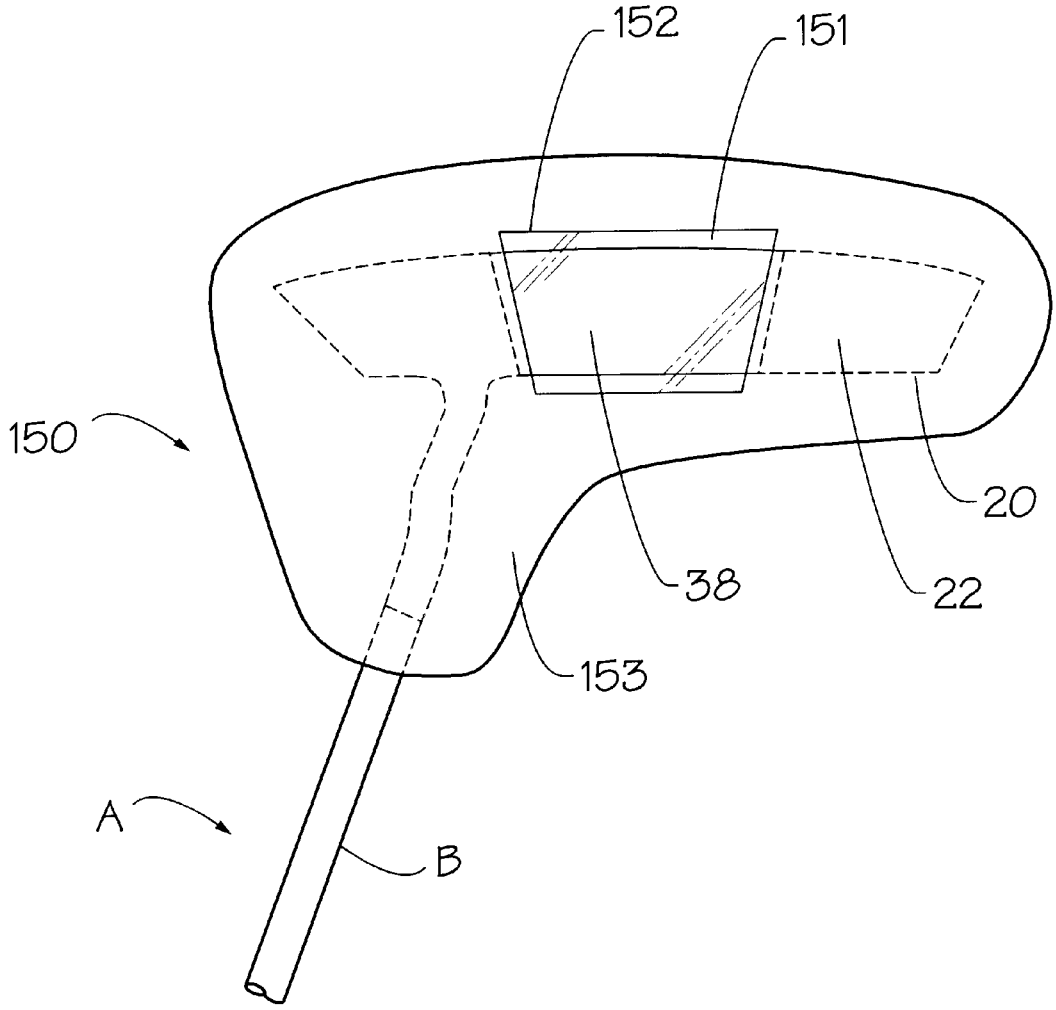
FIG. 8 is an upper perspective view of an inverted golf putter provided with a head of the type shown in FIG. 1, and showing the club head with a windowed protective cover according to the present invention.

FIG. 8 illustrates a protective golf club head cover or mitt that is particularly well suited to use with golf putters having color coded inserts according to the present invention. As shown in FIG. 8, a protective cover 150 according to the present invention is fitted over a putter head 20 of a putter A, the putter head being in an inverted position with a putter shaft B extending downwards into a golf bag (not shown) holding the putter. Protective cover 150, which is made of a soft, durable, drapable material such as soft leather or fabric, has a hollow tubular shape similar to that of a tube sock, and is adapted to be pulled over a putter head 20 and the lower portion of shaft B of putter A. A generally rectangularly-shaped, horizontal elongated transparent window 151 made of a thin transparent vinyl sheet or other such material, is attached within a similarly shaped aperture 152 formed in a side wall 153 of cover 150. Window 151 of protective cover 150 is so located within side wall 153 as to overly at least a portion of a color-coded rebound control insert 38 in the front face 22 of putter head 20, with the protective cover fitted over the putter head. This arrangement permits a golfer to easily determine which color-coded interchangeable insert 38 is currently installed on a putter 20.

What is claimed is:

1. A golf putter head comprising;

a. a head adapted to be attached to a shaft, said head including a body having a front face with an intended golf ball impact region, said front face of said body having formed therein a recess, and b. at least one rebound control insert releasably adapted to fit in said recess of said body, said insert having at least a front portion thereof made of a resilient polymer and providing a composite rebound factor having a predetermined value selected from a first plurality of values, said composite rebound factor being determined by the resiliency or intrinsic rebound factor of the particular material of which said insert is made and by the thickness of said insert in combination with the characteristics of said body, said composite rebound factor values being related by a predetermined, repeatable relationship to the roll distance of a ball impacted by said putter, and c. releasable fastening means for fastening said insert to said body.

2. The golf putter head of claim 1 wherein said insert is further defined as comprising in combination a front resilient pad comprising said front portion of said insert, and a backing plate fastened to said pad.

3. The golf putter head of claim 2 wherein said means for releasably attaching said insert to said putter head body comprises in combination at least one threaded hole in said backing plate, a through-hole provided through said body and aligned with said threaded-hole, and a headed screw received through said through-hole and threadably received by said threaded hole.

4. The putter head of claim 2 wherein said insert is further defined as having a front face substantially flush with the front face of said body.

5. The putter head of claim 1 wherein said composite rebound factor is further defined as being no more than about fifty percent.

6. The putter head of claim 5 wherein said hardness of said resilient portion of said insert is further defined as being between about Shore A 70 and Shore D 80.

7. The putter head of claim 6 wherein said polymer is further defined as being a polyurethane.

8. A golf putter head comprising;

a. a laterally elongated body having upper and lower wall surfaces and a generally flat front face with an intended region for impacting a golf ball, said face having formed therein a generally trapezoidally-shaped recess which extends through both said upper and lower wall surfaces of said body, b. at least one rebound control insert having a plan view shape complementary to that of said recess, said insert being adapted to fit conformally within said recess and having at least a front portion thereof made of a resilient polymer, said insert providing a composite rebound factor, for a ball impacted by said head, of a predetermined value selected from a first plurality of values, said composite rebound factor being determined by the resiliency or intrinsic rebound factor of the particular material of which said insert is made and by the thickness of said insert in combination with the characteristics of said body, said composite rebound factor values being related by a predetermined, repeatable relationship to the roll distance of a ball impacted by said putter, and c. releasable fastening means for fastening said insert to said body.

9. The golf putter head of claim 8 wherein said rebound control insert is further defined as comprising in combination at least one resilient pad, and a backing plate fastened to said pad, said pad and backing plate both having a plan-view shape complementary to the plan view shape of said recess in said face of said putter head body.

10. The golf putter head of claim 9 wherein said releasable fastening means is further defined as comprising in combination a pair of laterally spaced apart threaded holes which penetrate the rear surface of said backing plate, a pair of through-holes provided through said body and aligned with said threaded holes, and a pair of headed screws received individually through said through-holes and tightened onto said threaded holes.

11. The putter head of claim 9 wherein said resilient pad of said insert is further defined as comprising in combination a laminated stack of polymer inserts including said first polymer insert and at least one additional insert.

12. The putter head of claim 8 wherein said composite rebound factor is further defined as being no more than about fifty percent.

13. The putter head of claim 12 wherein said hardness of said resilient portion of said insert is further defined as being between about Shore A70 and Shore D80.

14. The putter head of claim 13 wherein said polymer is further defined as being a polyurethane.

* * * * *